US009903679B1

(12) United States Patent
Rowe et al.

(10) Patent No.: US 9,903,679 B1
(45) Date of Patent: Feb. 27, 2018

(54) MINIGUN WITH IMPROVED BARREL CLAMP

(71) Applicants: Thomas Rowe, Phoenix, AZ (US); Arthur O'Donnell, Gilbert, AZ (US)

(72) Inventors: Thomas Rowe, Phoenix, AZ (US); Arthur O'Donnell, Gilbert, AZ (US)

(73) Assignee: Profense, LLC, Phoenix, AZ (US)

( * ) Notice: Subject to any disclaimer, the term of this patent is extended or adjusted under 35 U.S.C. 154(b) by 0 days.

(21) Appl. No.: 15/783,167

(22) Filed: Oct. 13, 2017

Related U.S. Application Data

(63) Continuation of application No. 14/893,158, filed as application No. PCT/US2014/040626 on Jun. 3, 2014, now Pat. No. 9,791,241.

(60) Provisional application No. 61/830,553, filed on Jun. 3, 2013.

(51) Int. Cl.

| | |
|---|---|
| ***F41A 1/10*** | (2006.01) |
| ***F41A 21/48*** | (2006.01) |
| ***F41F 1/10*** | (2006.01) |
| ***F41A 21/34*** | (2006.01) |

(52) U.S. Cl.
CPC ..... *F41A 21/487* (2013.01); *F41A 21/34* (2013.01); *F41F 1/10* (2013.01)

(58) Field of Classification Search
CPC .. F41F 1/10; F41A 9/36; F41A 21/487; F41A 21/34
See application file for complete search history.

(56) References Cited

U.S. PATENT DOCUMENTS

| | | | | | |
|---|---|---|---|---|---|
| 1,328,230 | A * | 1/1920 | Johnston | F41A 9/35 | 89/1.1 |
| 2,837,076 | A * | 6/1958 | Koci | F41B 11/52 | 124/51.1 |
| 3,041,939 | A * | 7/1962 | Dardick | F41A 5/18 | 227/9 |
| 3,703,122 | A * | 11/1972 | Farrington | F41A 21/32 | 89/14.3 |
| 3,705,529 | A * | 12/1972 | Williams | F41A 21/08 | 89/14.2 |

(Continued)

FOREIGN PATENT DOCUMENTS

| | | | | |
|---|---|---|---|---|
| DE | 2006072 A1 * | 8/1971 | F41F 1/10 | |
| WO | WO-8505442 A1 * | 12/1985 | F41A 5/18 | |

*Primary Examiner* — Benjamin P Lee
(74) *Attorney, Agent, or Firm* — Richard E. Oney; Tiffany & Bosco, P.A.

(57) ABSTRACT

An improved barrel clamp assembly for a multi-barreled minigun includes a barrel clamp tube having a front end, a rear end, and a plurality of longitudinal openings extending along a portion the length of the tube between the front end and the rear end. An impeller is mounted in the barrel clamp tube between the tube front end and the tube rear end. The impeller includes a plurality of impeller blades that are spaced around a periphery of the impeller and that project forward from a rear flange portion of the impeller and the impeller blades define a plurality of air channels. A barrel assembly includes the barrel clamp tube, a flash suppressor mounted to the front end of the barrel clamp tube, and a barrel clamp collar mounted to the rear end of the barrel clamp tube. The impeller is mounted to the barrel clamp tube between the flash suppressor and the barrel clamp collar.

20 Claims, 10 Drawing Sheets

(56) References Cited

U.S. PATENT DOCUMENTS

| | | | | | |
|---|---|---|---|---|---|
| 4,117,978 | A * | 10/1978 | Fuchs | F04F 1/06 | 159/43.2 |
| 4,179,978 | A * | 12/1979 | Kirkpatrick | F41A 21/08 | 89/12 |
| 4,398,445 | A * | 8/1983 | Ulrich | F41A 21/08 | 89/12 |
| 4,574,682 | A * | 3/1986 | Hillman | F41F 1/10 | 89/12 |
| 4,656,919 | A * | 4/1987 | Farinacci | F41A 21/46 | 89/14.6 |
| 5,485,775 | A * | 1/1996 | Duke | F41A 21/32 | 89/12 |
| 5,583,313 | A * | 12/1996 | Austin | F41A 21/34 | 89/14.2 |
| 6,837,139 | B2 * | 1/2005 | Meyers | F41A 21/34 | 42/77 |
| 8,276,496 | B2 * | 10/2012 | Garwood | F41A 9/00 | 89/12 |
| 8,316,751 | B2 * | 11/2012 | Dillon | F41A 21/08 | 24/284 |
| 8,418,803 | B2 * | 4/2013 | Findlay | F41A 21/30 | 181/223 |
| 2010/0192759 | A1 * | 8/2010 | Garwood | F41A 13/12 | 89/12 |
| 2011/0185883 | A1 * | 8/2011 | Garwood | F41A 9/00 | 89/12 |
| 2012/0118132 | A1 * | 5/2012 | Coker | F41A 7/08 | 89/13.05 |

* cited by examiner

MINIGUN WITH IMPROVED BARREL CLAMP

RELATED APPLICATION AND PRIORITY CLAIM

This application is a continuation of and claims the priority of U.S. patent application Ser. No. 14/893,158, entitled " Minigun with Improved Barrel Clamp," which is incorporated herein by reference. This application claims priority to, and incorporates by reference the following: Patent Cooperation Treaty (PCT) patent application serial number PCT/US14/40626, filed Jun. 3, 2014, which claims priority to U.S. provisional patent application No. 61830553, filed Jun. 3, 2013, entitled: Minigun with Improved Barrel Clamp, which is incorporated herein by reference.

BACKGROUND

This invention relates generally to Gatling-type miniguns. More specifically, it relates to an improved barrel clamp assembly for an electrically powered minigun.

Gatling-type miniguns have been known for many years. The Gatling-type minigun is a multi-barreled machine gun with a high rate of fire (2,000 to 6,000 rounds per minute). It features Gatling-style rotating barrels with an external power source, such as an electric motor. One previous example of such a gun is described in U.S. Pat. No. 7,971,515 B2, entitled "Access Door for Feeder and Delinker of a Gatling Gun," which is incorporated herein by this reference. Long existing motivations in the design of Gatling-type miniguns have been to minimize jams, extend the operational life and improve ease of use of such guns.

Gatling-type miniguns include a barrel assembly for holding and rotating barrels. It is a principal object of the present invention to provide an improved barrel clamp assembly for a barrel assembly of such a minigun.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY

To achieve the foregoing objects, and in accordance with the purposes of the invention as embodied and broadly described in this document, there is provided an improved barrel clamp assembly for a multi-barreled minigun. In some embodiments, the barrel clamp assembly includes a barrel clamp tube having a front end, a rear end, and a plurality of longitudinal openings extending along a portion the length of the tube between the front end and the rear end. An impeller is mounted in the barrel clamp tube between the tube front end and the tube rear end. In one advantageous embodiment, the impeller includes a plurality of impeller blades that are spaced around a periphery of the impeller, that project forward from a rear flange portion of the impeller and that define a plurality of air channels.

In some embodiments of a barrel assembly that utilize a barrel clamp tube according to the present invention, the barrel assembly includes a barrel clamp tube having plurality of longitudinal openings, a flash suppressor mounted to the front end of the barrel clamp tube, and a barrel clamp collar mounted to the rear end of the barrel clamp tube. An impeller is mounted to the barrel clamp tube between the flash suppressor and the barrel clamp collar.

In this configuration, the improved barrel clamp assembly provides a lightweight barrel clamp with improved performance and cooling characteristics.

BRIEF DESCRIPTION OF THE DRAWINGS

The accompanying drawings and appendices, which are incorporated in and constitute a part of the specification, illustrate the presently preferred embodiments of the invention and, together with the general description given above and the detailed description of the preferred methods and embodiments given below, serve to explain the principles of the invention.

DESCRIPTION

Figure 1A:
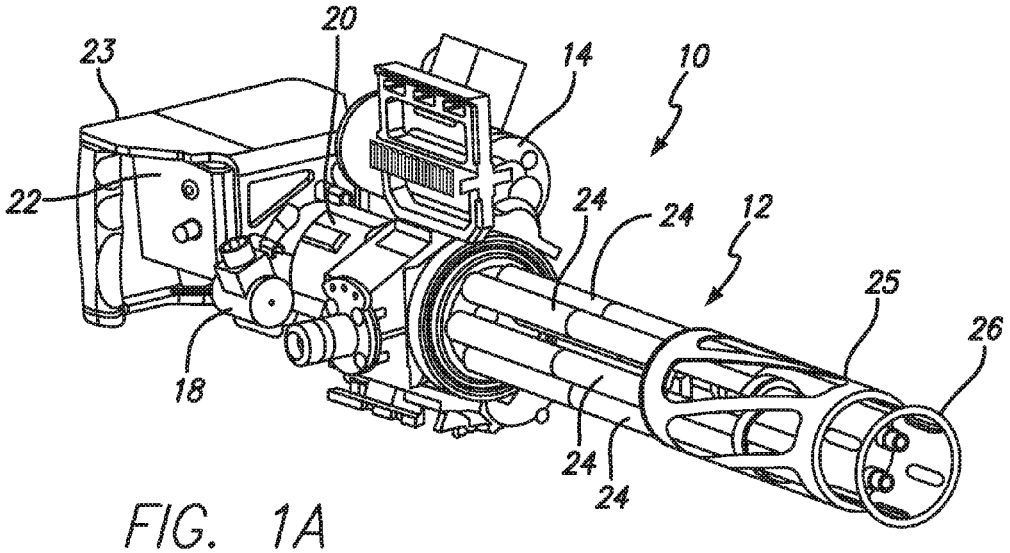
FIG. 1A is a top perspective view showing one side of an electrically-powered minigun that includes one embodiment of an improved barrel clamp assembly according to the present invention.

A preferred embodiment of a barrel clamp assembly according to the present invention is shown and generally designated by the reference numeral 25. In the context of the specification, the terms "rear" or "rearward" mean in the direction towards the chamber end of the barrels 24, while the terms "front" or "forward" mean in the direction towards the muzzle end of the barrels 24.

Figure 1B:
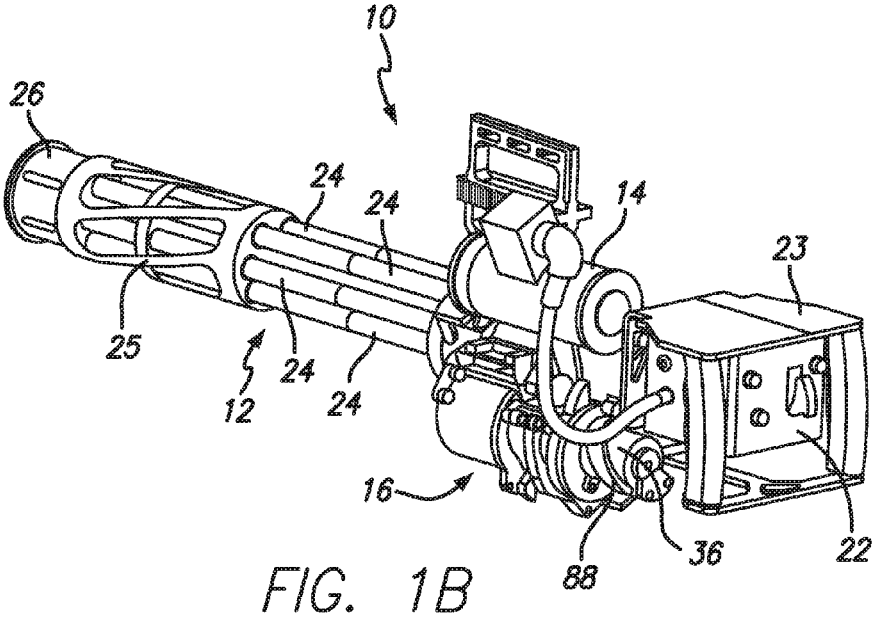
FIG. 1B is a top perspective view showing the other side of the minigun of FIG. 1A.

FIGS. 1A and 1B illustrate a 7.62×51 mm minigun 10 suitable for use with the present invention. The minigun 110 includes a barrel assembly 12, an electric drive motor 14 to rotate the barrel assembly 12, a delinking feeder 16, a clutch assembly 18, a gun housing assembly 20, a gun control unit 22, and a spade grip 23. The barrel assembly 12 includes a barrel clamp assembly 25, a plurality of barrels 24 circumferentially mounted to the barrel clamp assembly 25, and a flash suppressor 26. Ammunition is fired sequentially through the barrels 24 in a known fashion, i.e., first one barrel is used, then the next, then the next, etc. An electric cable 28 supplies power from the gun control unit 22 to the drive motor 14. The delinking feeder 16, which is an ammunition feed device, is engaged and disengaged via the electric cable 28. To provide access to the interior of the delinking feeder 16, an access door assembly 30 is mounted on the delinking feeder 16. The access door assembly 30 includes an access door 32 that is movable between a first closed operative position and a second open position to facilitate the loading of an ammunition belt 101 of linked cartridges 80. A portion of such an ammunition belt is depicted in FIG. 2.

As is well known to those of skill in the art, in the operation of the minigun 10, the drive motor 14 causes the barrel assembly 12 to rotate, and each barrel 24 fires sequentially in rapid succession. During such operation, the delinking feeder 16 receives the ammunition belt 101 of linked cartridges 80 (see FIG. 2), sequentially separates or "delinks" the cartridges 80 from the ammunition belt 101 and feeds the cartridges 80 to the minigun firing mechanism (not shown).

Still referring to FIGS. 1A and 1B, when an arming switch on the gun control unit 22 is activated, and one or both firing buttons are then depressed, the gun will fire. When the firing buttons are released, the delinking feeder 16 is disengaged so the ammunition supply is discontinued. The electric drive motor 14 continues to rotate for about 200 to 400 milliseconds so that the weapon is cleared of remaining ammunition before stopping. A booster motor override control button on the gun control unit 22, when depressed, activates an ammunition booster motor on the ammunition magazine (not shown) to facilitate the loading of the weapon. The booster motor pushes the ammunition belt 101 from the ammunition magazine, through the feed chute, and to the weapon where it is inserted in the delinking feeder 16, readying the weapon for firing.

Figure 2:
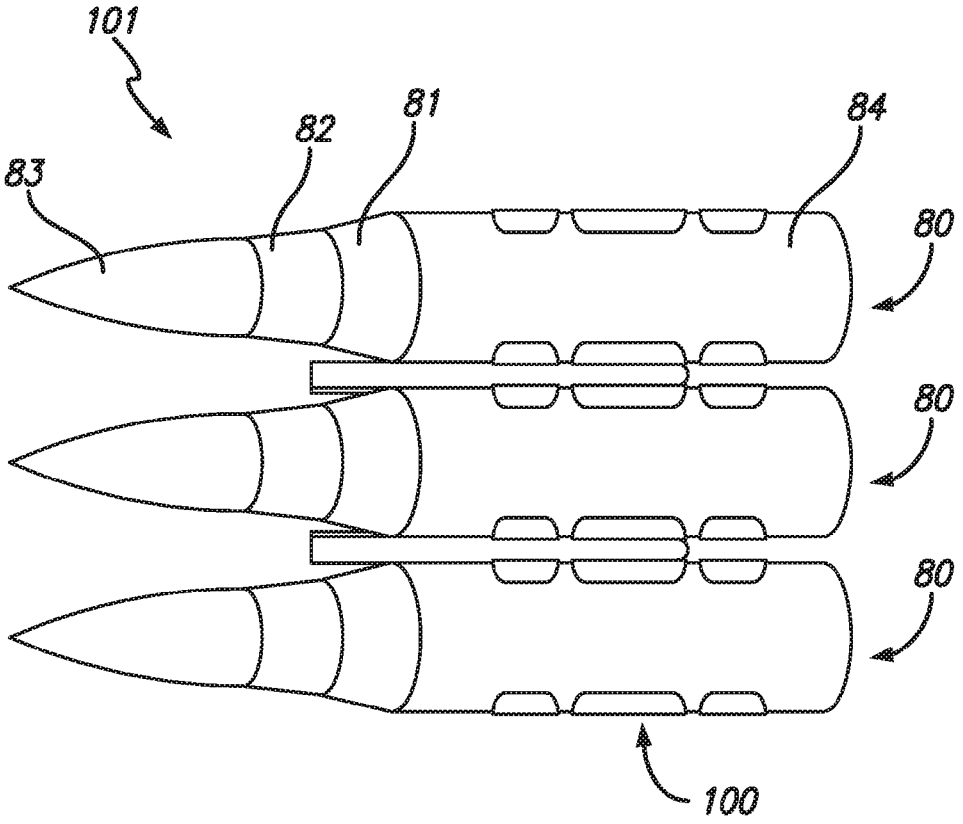
FIG. 2 PRIOR ART
FIG. 2 is a perspective view showing an ammunition belt of the prior art.

Referring to FIG. 2, each of the cartridges 80 in the ammunition belt 101 includes a cylindrical hollow casing 84 comprising the rear portion of cartridge 80. A primary conical tapered shoulder 81 extends from casing 84 to a conical tapered neck 82. Neck 82 extends from the shoulder 81 to a projectile or bullet 83.

Figure 3:
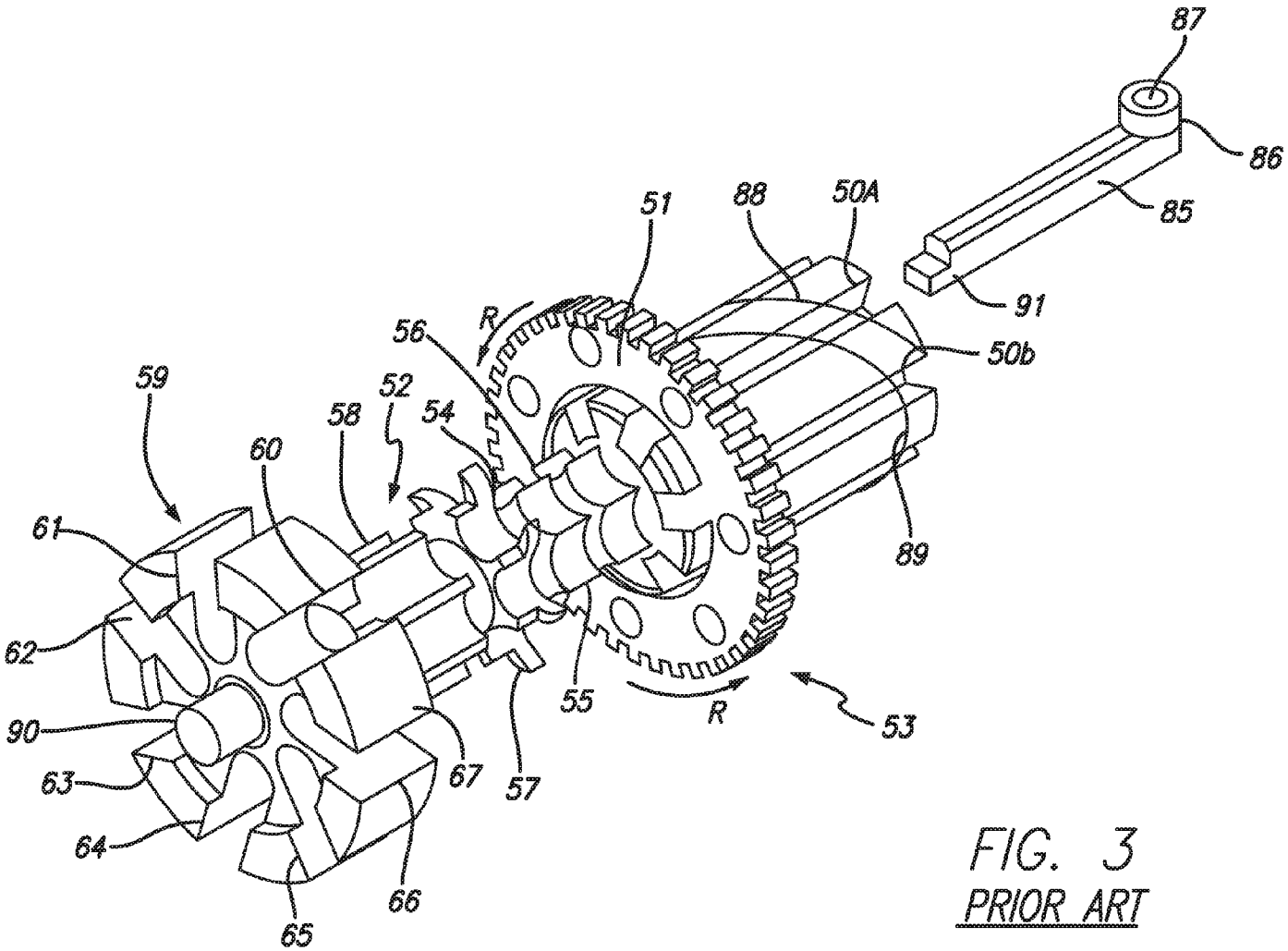
FIG. 3 PRIOR ART
FIG. 3 is a perspective view showing the interior of a prior art delinking feeder.
Figure 4:
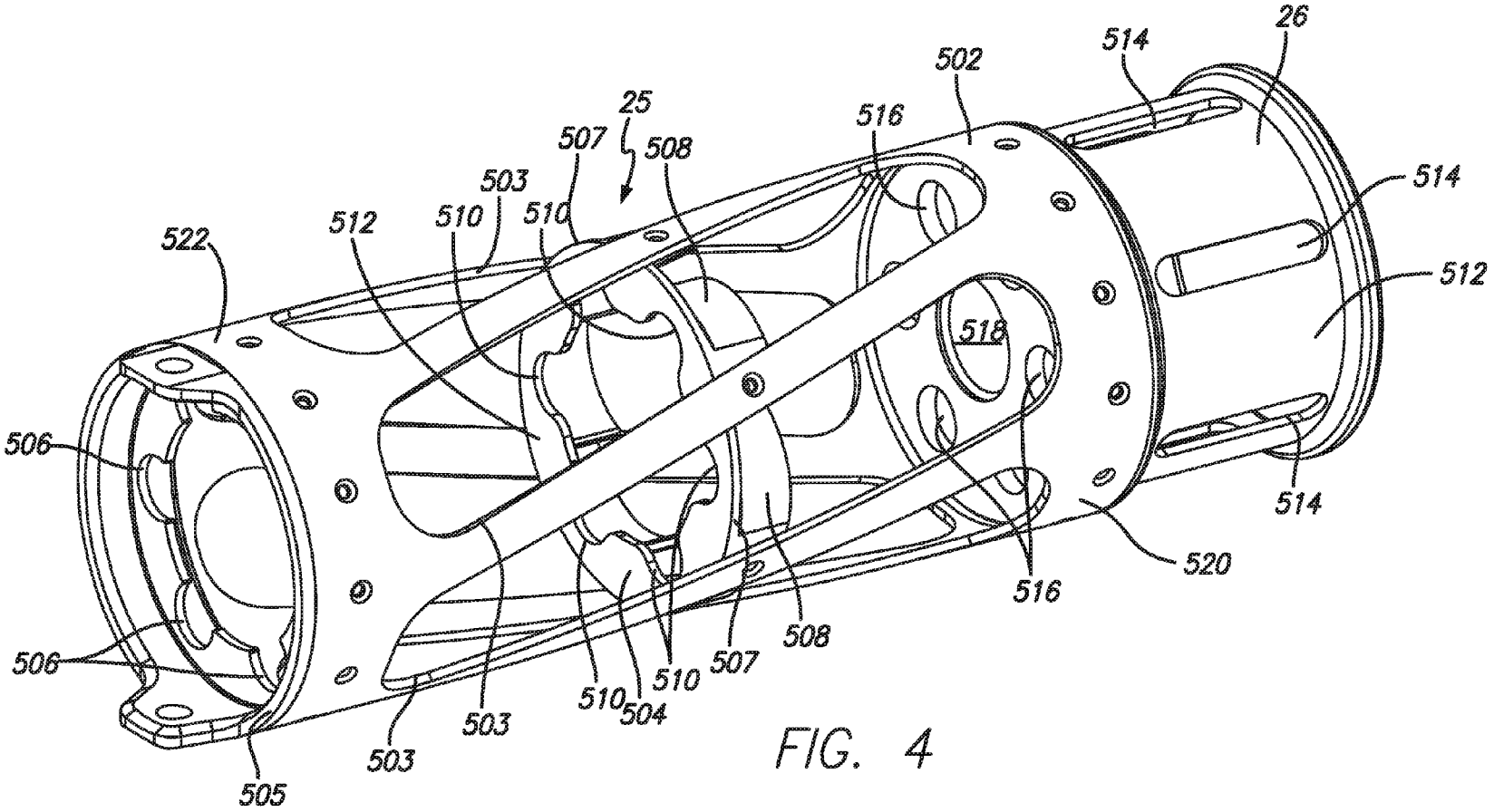
FIG. 4 is a rear perspective view of the improved barrel clamp assembly of the minigun of FIGS. 1A and 1B.
Figure 5:
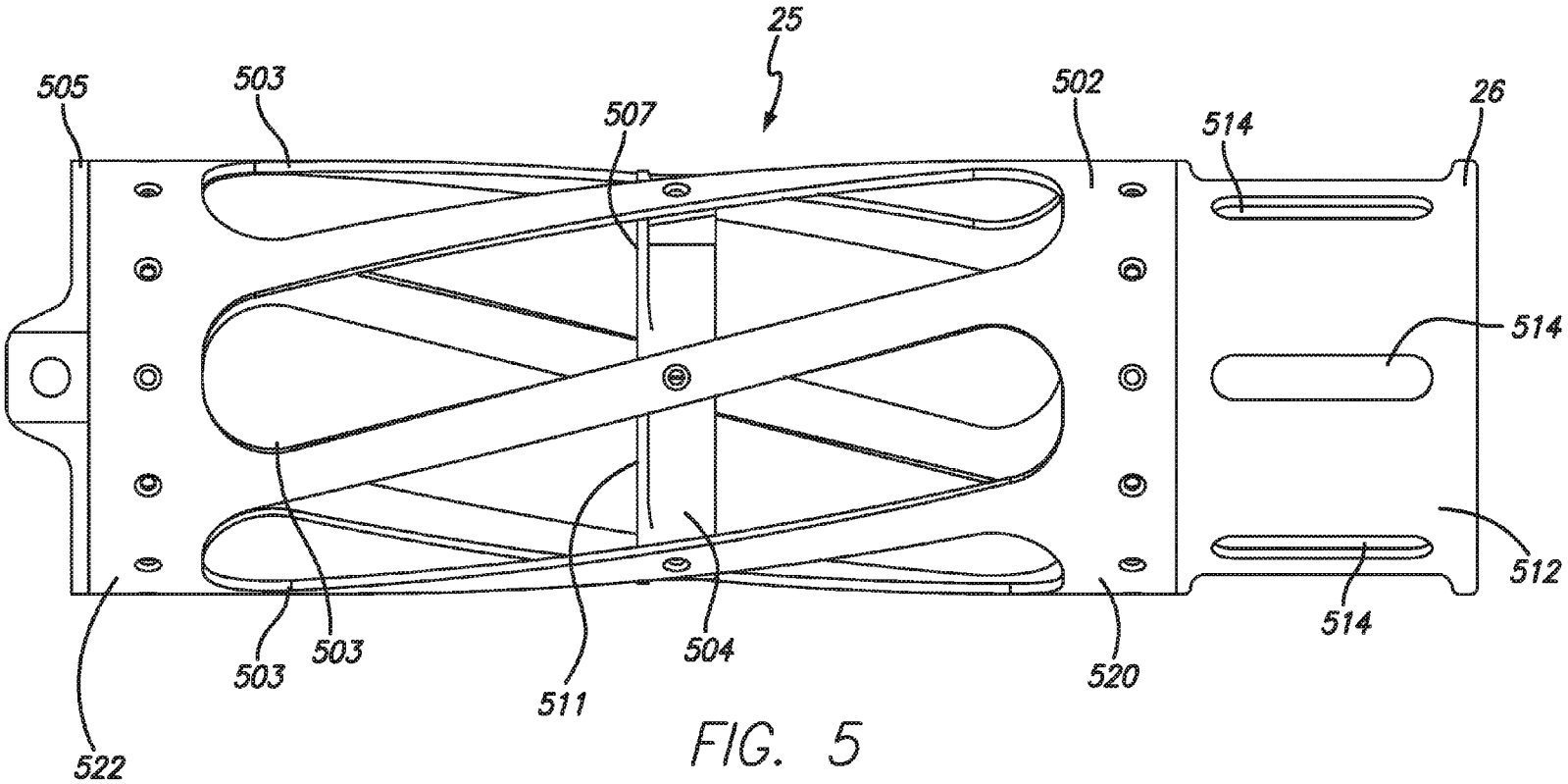
FIG. 5 is a side elevation view of the barrel clamp assembly of FIG. 4.
Figure 6:
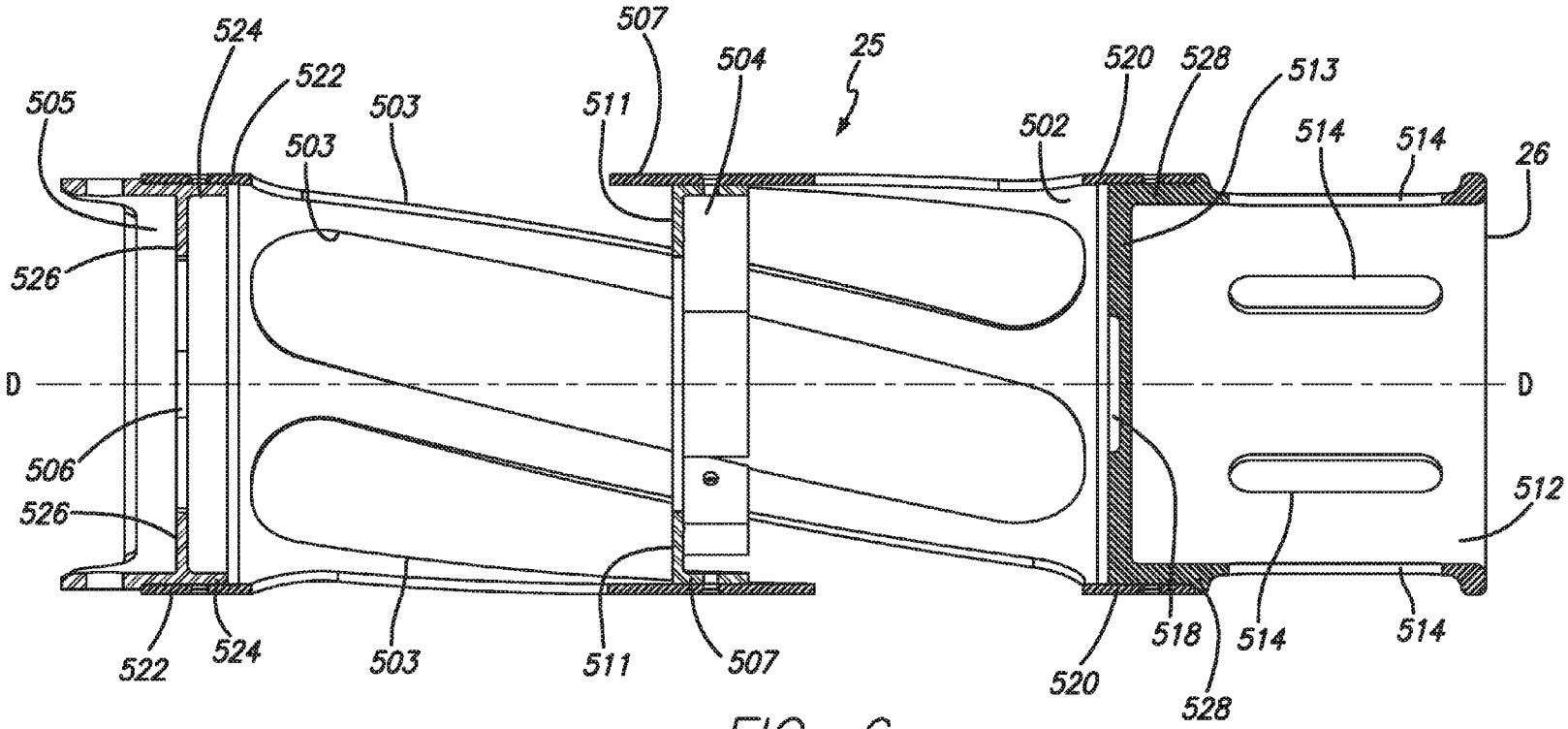
FIG. 6 is a cross-sectional side elevation view of the barrel clamp assembly of FIG. 4, illustrating the barrel clamp collar, impeller and flash suppressor mounted to the barrel clamp tube.

FIG. 3 illustrates internal components of a prior art delinking feeder 16. As shown in FIG. 3, a guide assembly 53 includes feeder shaft 90 that rotates (in a direction indicated by arrows R) on an axis that is parallel to the axis about which the barrel assembly 12 rotates. During operation, the guide assembly 53 continuously rotates to receive the ammunition belt 101, to remove cartridges 80 from the belt, and to feed the cartridges 80 for firing. Securely mounted to the feeder shaft 90 is a series of components, including a push rod guide 49, a toothed drive gear 51, sprockets 55, 56, a stripper sleeve 52 (including sprockets 54, 57 and 58), and a feeder sprocket 59. The drive motor 14 is rotationally coupled, via the drive gear 51, to the feeder shaft 90 and the push rod guide 49, sprockets 55, 56, stripper sleeve 52, and feeder sprocket 59. Each of the sprockets 54-58 has seven equally spaced grooves, with each groove having a generally semi-cylindrical shape for receiving a cartridge 80. Sprockets 55 and 56 comprise a cartridge holding construct for holding cartridges 80 that are linked to an ammunition belt 101 that has been inserted into the delinking feeder 16.

Still referring to FIG. 3, the guide assembly 53 includes a plurality of push rods 85, with one push rod 85 corresponding to each barrel 24 of the minigun 10. For example, in a minigun with a barrel assembly having six barrels 24, the guide assembly 53 has six push rods 85. The push rod guide 49 has a generally cylindrical body with longitudinal slots 50A uniformly distributed about its surface. Each of the push rods 85 can move longitudinally inside its associated longitudinal slot 50A. An arcuate outer surface 50B extends between each adjacent pair of slots 50A. Each groove in a sprocket 54 to 59 is aligned with one of the slots 50A. Each slot 50A slidably receives a push rod 85. Each push rod 85 has a wheel 86 rotatably secured to its rearward end by an axle 87 that extends outwardly from the outer face of the push rod 85. Each wheel 86 is confined within a spiral grooved channel, represented in FIG. 3 by the broken lines 88, which is incorporated into a feeder cam housing 36, as shown in FIG. 1B. As the push rod guide 49 is rotated about its axis by means of the drive motor 14, each of the push rods 85 is constrained by its respective drive wheel 86 to follow the path of the spiral channel 88, thereby slidably moving forward and backward in its associated longitudinal slot 50A with each rotation of the push rod guide 49. As a push rod 85 moves forward toward the drive gear 51, the push rod distal end 91 engages the rear of a cartridge 80 and pushes the cartridge 80 forward. As the cartridge 80 is driven forward, it is freed, or delinked, from the link 100 holding it (see FIG. 2) and is pushed toward and into the feeder sprocket 59 to be handed off to the minigun firing mechanism (not shown).

Still referring to FIG. 3, the stripper sleeve 52 (which includes sprockets 54, 57 and 58) is designed to receive and prevent longitudinal movement of a cartridge link 100 in the ammunition belt 101 so that a cartridge 80 can be pushed free of its associated link 100 by one of the push rods 85, i.e., the stripper sleeve 52 "holds" the cartridge link 100 while the cartridge 80 is pushed free by one of the push rods 85. The feeder sprocket 59 receives each cartridge 80 that is separated from the ammunition belt 101, and then hands off the cartridge 80 for firing.

Referring now to FIGS. 4-10, a preferred embodiment of the barrel clamp assembly 25 includes a barrel clamp tube 502 for holding the barrels 24 in a circumferential, spaced relationship. The barrel clamp tube 502 has a plurality of longitudinal openings 503, each of which extends along a substantial portion of the length of the barrel tube clamp 502. A flash suppressor 26 is mounted to the front end 520 of the barrel clamp tube 502 and a barrel clamp collar 505 is attached to the rear end 522 the barrel clamp tube 502. According to one novel aspect of the barrel clamp assembly 25, an impeller 504 is mounted in the barrel clamp tube 502 between the barrel clamp collar 505 and the flash suppressor 26 for providing improved cooling of the barrels 24.

As can be seen in FIGS. 4-7, the barrel clamp collar 505 is a ring-like body of one-piece construction that includes an attachment portion 524 that is adapted for attaching to the tube rear end 522, such as by rivets or other suitable attachment means. An inwardly projecting flange portion 526 has six barrel cutouts 506 for receiving the barrels 24 and holding them parallel to the longitudinal main axis D of the barrel clamp assembly 25 and the barrel clamp tube 502.

The flash suppressor 26 has a can-like body of one-piece construction with an open forward portion 512 and a rear panel 513 that has six barrel apertures 516 for receiving the barrels 24 and holding them parallel to the longitudinal main axis D. The flash suppressor barrel apertures 516 are axially registered with the collar barrel cutouts 506 to receive the barrels 24. The suppressor rear panel 513 also includes a center hole 518 for reducing weight. The flash suppressor 26 includes an attachment portion 528 that is adapted for attaching to the tube front end 520, such as by rivets or other suitable attachment means. Unlike some prior art barrel clamp designs, the barrel clamp assembly of 25 does not require a central support shaft because the barrel clamp tube 502 provides the required strength and stiffness without using such a central support shaft.

As can be seen in FIG. 1A, when the barrels 24 are held within the barrel clamp tube 502, the flash suppressor forward portion 512 extends forward of the barrel muzzle ends to suppress flashes emitted from the muzzle ends resulting from firing of the minigun. Referring to FIGS. 4-6 and 10, the flash suppressor forward portion 512 includes longitudinal slots 514 for reducing the flash associated with a muzzle blast. In operation, when the minigun 10 is fired, a bullet 83 exiting the muzzle travels along the longitudinal axis of the barrel 24 through the interior of the flash suppressor forward portion 512. Following the bullet, the hot, high pressure gases of the muzzle blast enter the suppressor forward portion 512. As they do so, they begin to expand outwardly through the slots 514 into the surrounding ambient air and are cooled, which reduces the flash associated with muzzle blast. In some embodiments, such as the embodiment of FIG. 10, the slots 514 have diverging sidewalls 530, which can permit the muzzle blast gases to expand more fully before reaching the surrounding ambient air, and can further reduce the flash from the muzzle blast.

Referring to FIGS. 4-9, the impeller 504 is an open impeller (i.e., the impeller blades 508 are not covered) and is mounted within the barrel clamp tube 502 midway between the barrel clamp collar 505 and the flash suppressor 26. The impeller 504 has a ring-like body of one-piece construction and includes a peripheral rim portion 507 and attachment portion 505 that is adapted for attaching to the barrel clamp tube 502, such as by rivets or other suitable attachment means. A rear flange portion 511 projects inwardly and perpendicular to the longitudinal main axis D. The rear flange portion 511 defines six barrel cutouts 510 for receiving the barrels 24 and holding them parallel to the longitudinal main axis D. A plurality of curved impeller blades 508 are equally spaced around the periphery of the impeller 504 and project forward from the rear flange portion 511. The blades 508 are curved inwardly toward the longitudinal main axis D and define a plurality of channels 532, each of which is between two of the blades 508. In the embodiment of the impeller 504 shown in FIGS. 4-10, for example, the impeller 504 has six impeller blades 508 which define six channels 532.

Figure 7:
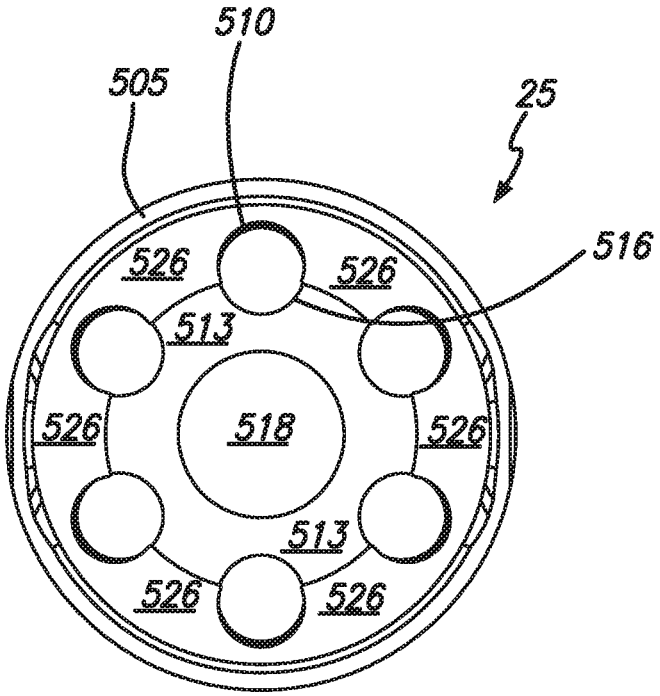
FIG. 7 is a rear end elevation view of the barrel clamp assembly of FIG. 4.
Figure 8:
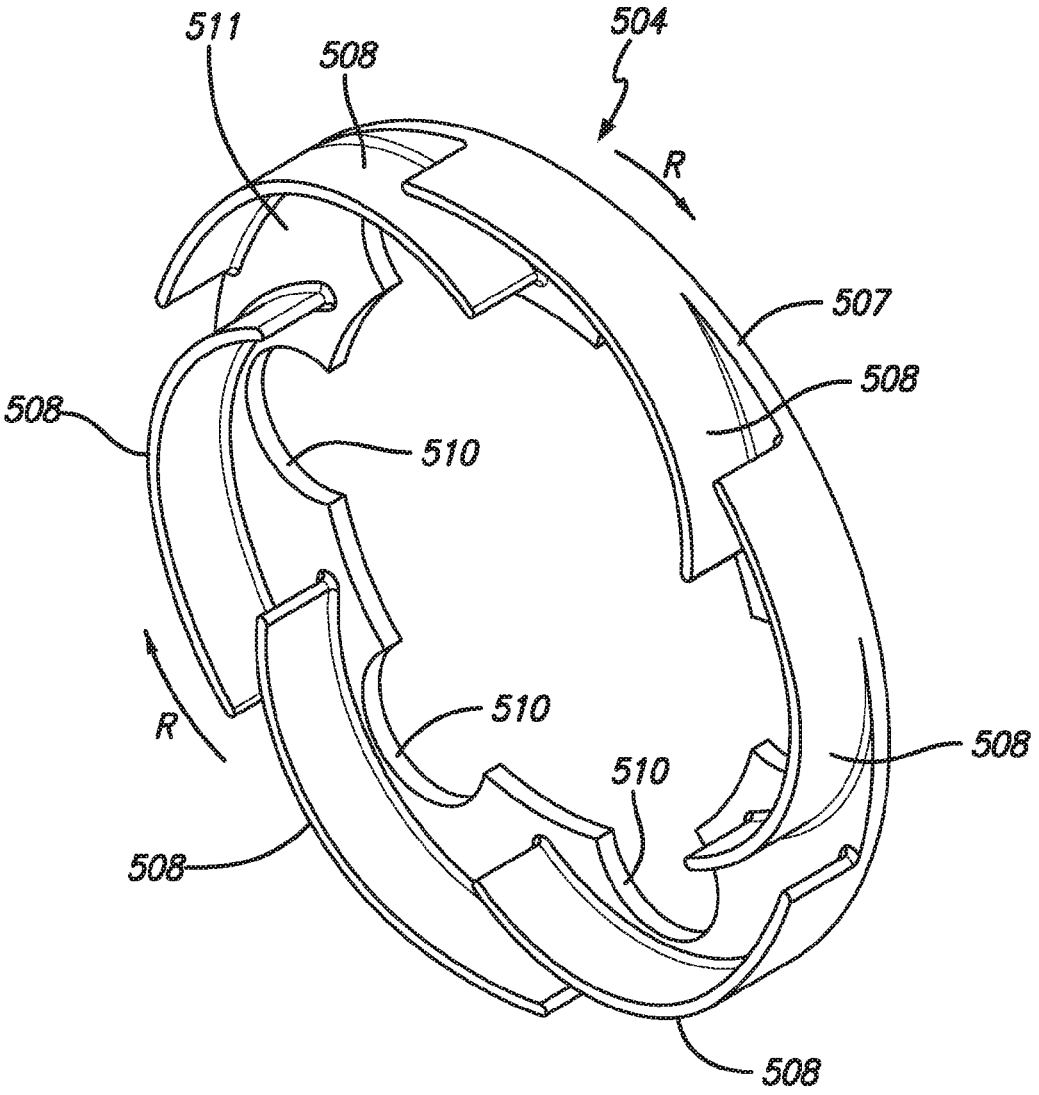
FIG. 8 is a front perspective view of the impeller of the barrel clamp assembly of FIG. 4, which is one embodiment of an impeller according to the present invention.
Figure 9:
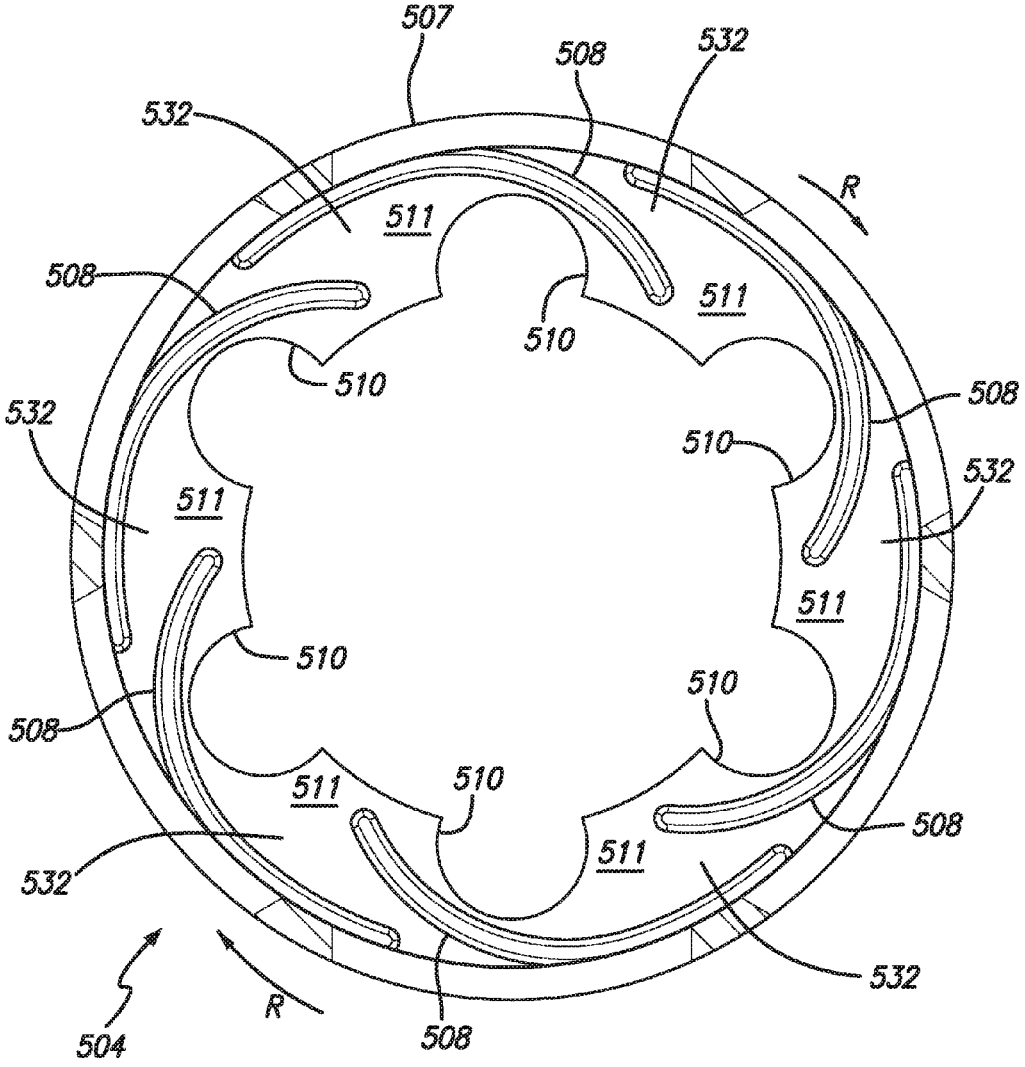
FIG. 9 is a front elevation view of the impeller of FIG. 8.
Figure 10:
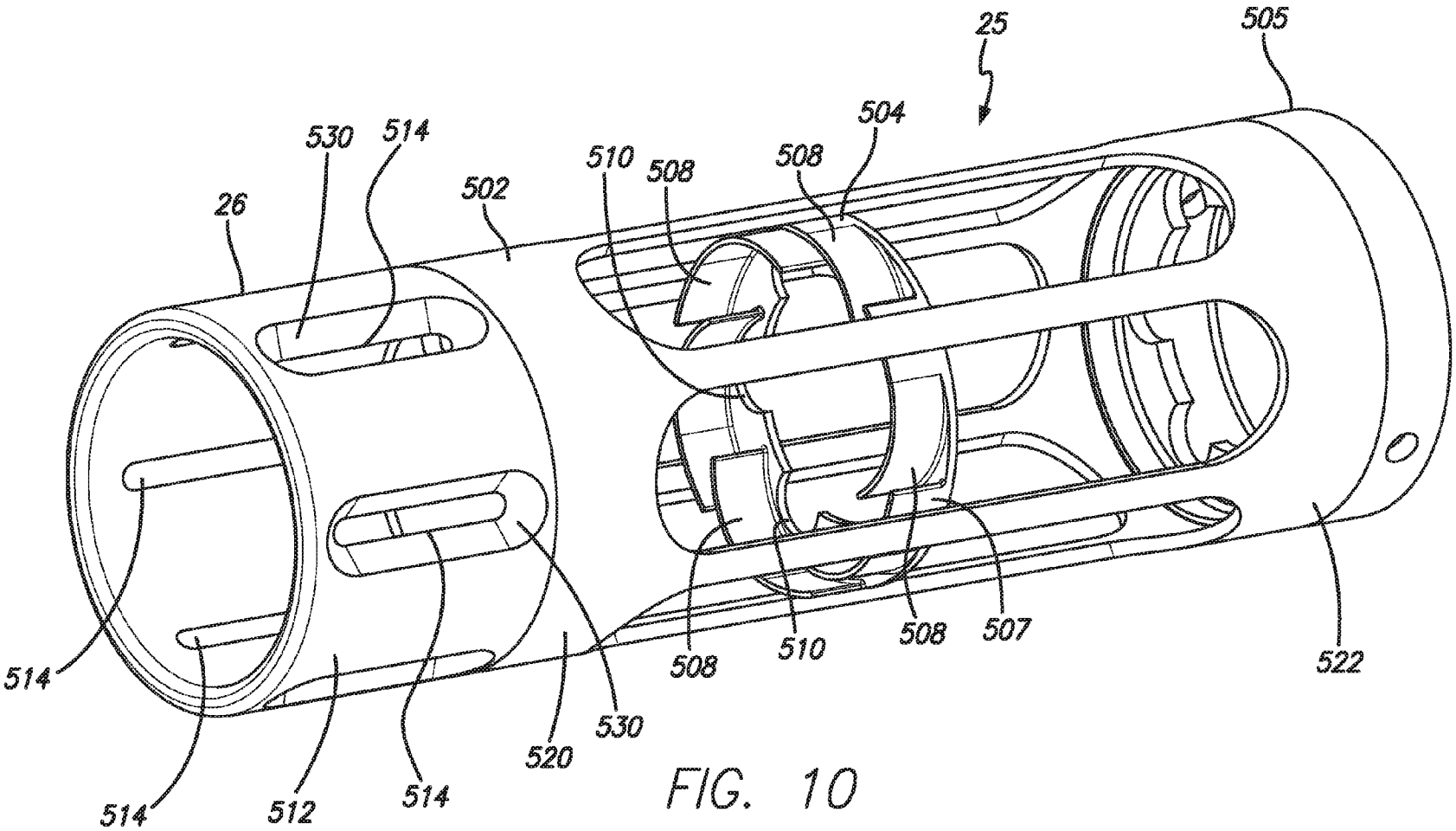
FIG. 10 is front perspective view of another embodiment of an improved barrel clamp assembly according to the present invention.

As shown in FIG. 7, when the barrel assembly 12 is assembled, the collar barrel cutouts 506, impeller barrel cutouts 510 and flash suppressor barrel apertures 516 are axially registered with each other to receive the barrels 24.

In operation, the impeller 504 rotates with the barrel clamp tube 502 as the barrel assembly 12 and the barrel clamp assembly 25 rotate. Thus, when the minigun 10 is firing and the drive motor 14 is causing the barrel assembly 12 to rotate, the impeller 504 is also rotating. During this rotation, the impeller 504 moves surrounding ambient air through the tube longitudinal openings 503 and over the portion of the barrels 24 within the barrel clamp tube 502, thereby cooling the barrels 24. In addition to allowing for air flow, the longitudinal openings 503 advantageously reduce the weight of the barrel clamp tube 502.

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. An improved barrel clamp assembly for holding barrels of a multi-barrel, rotating firearm in a circumferential spaced relationship and generally parallel to a longitudinal axis of rotation, the barrel clamp assembly comprising:

a tubular member having a peripheral wall defining an interior space aligned along the longitudinal axis, wherein the tubular member cross-section is sized for receiving a plurality of barrels and the peripheral wall includes a plurality of openings to the interior space; and a plurality of curved impeller blades positioned near and spaced around the periphery of the interior space and curved inwardly toward the longitudinal axis;

wherein the impeller blades are positioned in relation to the peripheral wall openings so that, when the barrels are installed and the barrel clamp assembly is rotated about the longitudinal axis, the impeller blades will move air through the peripheral wall openings to cool the barrels.

2. The improved barrel clamp assembly of claim 1 wherein the impeller blades project longitudinally from a flange that projects inwardly from the tubular member peripheral wall.

3. The improved barrel clamp assembly of claim 1 further comprising an impeller body comprising:

a peripheral attachment portion adapted for attaching to the peripheral wall; and a flange projecting inwardly from the peripheral attachment portion; and wherein each of the plurality of impeller blades projects longitudinally from the flange.

4. The improved barrel clamp assembly of claim 1, wherein the plurality of impeller blades includes a pair of impeller blades comprising a first impeller blade disposed in a partial overlapping relationship with a second impeller blade so that a channel is defined between the pair of impeller blades.

5. The improved barrel clamp assembly of claim 4 wherein the channel has an end positioned near to one of the peripheral wall openings and an opposing end positioned so that, when the barrels are installed in the barrel clamp assembly, the opposing end is near one of the barrels.

6. The improved barrel clamp assembly of claim 1 wherein each of the peripheral wall openings comprises an elongated vent.

7. The improved barrel clamp assembly of claim 1 wherein the number of impeller blades equals the number of barrels that can be installed in the barrel clamp assembly.

8. An impeller for use with an improved barrel clamp assembly that holds barrels of a multi-barrel, rotating firearm in a circumferential spaced relationship and generally parallel to a longitudinal axis of rotation, the impeller comprising:

a peripheral rim configured for attaching the impeller to a tubular member of a barrel clamp;

a base plate that projects inwardly from the peripheral rim and that defines one or more openings configured to receive barrels installed within the barrel clamp assembly so that each of the barrels will extend longitudinally through the impeller body; and a plurality of impeller blades disposed near and spaced about the peripheral rim;

wherein the impeller blades are configured so that when the impeller is rotated with the barrels about the longitudinal axis, the impeller blades will move air over the barrels.

9. The impeller of claim 8 wherein each of the impeller blades is curved inwardly away from the peripheral rim.

10. The impeller of claim 8 wherein each of the impeller blades projects longitudinally from the base plate.

11. The impeller of claim 8, wherein the plurality of impeller blades includes a pair of impeller blades comprising a first impeller blade disposed in a partial overlapping relationship with a second impeller blade so that a channel is defined between the pair of impeller blades.

12. The impeller body of claim 8 wherein the one or more base plate openings comprise a center hole having a periphery with a plurality of cutouts wherein each of the cutouts is configured to receive a barrel.

13. A multi-barrel, rotating firearm comprising:

a rotatable tube having a peripheral wall defining an interior space aligned along a longitudinal axis of rotation, wherein the peripheral wall has a plurality of openings to the interior space;

a plurality of gun barrels mounted within the tube interior space in a circumferential spaced relationship and parallel to the rotational axis so that the gun barrels will rotate when the tube rotates, wherein at least a portion of the length of each of the barrels is disposed within the tube interior space; and an impeller comprising a plurality of impeller blades disposed near and spaced about the periphery of the interior space and directed inwardly;

wherein the impeller blades are positioned in relation to the peripheral wall openings so that, when the tube and gun barrels rotate about the longitudinal axis, the impeller blades will move air through the peripheral wall openings to cool the barrels.

14. The firearm of claim 13 wherein one or more of the impeller blades is curved inwardly toward the longitudinal axis.

15. The firearm of claim 13 wherein the impeller blades project longitudinally from a flange that projects inwardly from the tube peripheral wall.

16. The firearm of claim 13 further comprising an impeller body having a peripheral attachment portion adapted for attaching to the tube peripheral wall, and a flange projecting inwardly from the peripheral attachment portion;

wherein each of the plurality of impeller blades projects longitudinally from the flange.

17. The firearm of claim 13 wherein the plurality of impeller blades includes a pair of impeller blades comprising a first impeller blade disposed in a partial overlapping relationship with a second impeller blade so that a channel is defined between the pair of impeller blades.

18. The firearm of claim 17 wherein the channel has an end adjacent to one of the peripheral wall openings and an opposing end positioned adjacent one of the barrels.

19. The firearm of claim 13 wherein each of the peripheral wall openings comprises an elongated vent.

20. The firearm of claim 13 wherein each of the impeller blades has a longitudinal dimension that is less than the portion of the length of the barrels disposed within the tube interior space.

* * * * *